United States Patent [19]

Otsuka

[11] Patent Number: 4,947,611

[45] Date of Patent: Aug. 14, 1990

[54] A WALL MATERIAL, AND METHOD OF PREPARING A WALL MATERIAL OF SOILS AND VEGETABLE MATERIALS

[76] Inventor: Michio Otsuka, 23-8, 3-Chome, Ooizumigakuen-cho, Nerima-ku, Tokyo, Japan

[21] Appl. No.: 300,433

[22] Filed: Jan. 23, 1989

[30] Foreign Application Priority Data

Jan. 22, 1988 [JP] Japan ..... 63-12178

[51] Int. Cl.[5] ..... E04C 1/04; C08G 18/12

[52] U.S. Cl. ..... 52/590; 521/100; 521/154; 521/155; 528/232; 52/DIG. 9

[58] Field of Search ..... 52/590, DIG. 9; 521/154, 100, 155; 528/242, 232

[56] References Cited

U.S. PATENT DOCUMENTS 3,983,081 9/1976 Dieterich et al. ..... 521/100

4,052,347 10/1977 Dieterich et al. ..... 521/155

4,097,422 6/1978 Markusch ..... 521/154

4,242,497 12/1980 Blounti ..... 528/232

*Primary Examiner*—Richard E. Chilcot, Jr.

*Attorney, Agent, or Firm*—McGlew & Tuttle

[57] ABSTRACT

A wall board structure is formed of one of pulverized straw, pulverized chaff and pulverized palm material having a maximum dimension of from 1 to 3 mm. The pulverized material is mixed with a substantially equal quantity of clay. A fibrous material is added to the mixture, the fibrous material including one or more of palm material fibers, hemp fibers and shredded straw, the fibrous material having a length of from 3 to 5 cm. The mixture of pulverized material and clay and the added fibrous material is poured into a form and then dried. The form preferably includes means for forming one of recesses and through holes in the poured mixture.

5 Claims, 3 Drawing Sheets

A WALL MATERIAL, AND METHOD OF PREPARING A WALL MATERIAL OF SOILS AND VEGETABLE MATERIALS

BACKGROUND OF THE INVENTION

The present invention relates to a wall material made of vegetable materials such as soils, straws, chaffs, hemp, palms and the like.

In the past, walls of the wooden buildings in Japan are mainly formed in a so-called tuchi kabe (soil wall) type. In this type of wall, a nuki (a horizontal member that is arranged one upon the other in a space between columns having its opposite ends extended through columns) is provided as a support member, a komai (a member to be deployed as a bed of a wall) is formed using bamboos, woods, straw ropes and the like around an intermediate column which is erected between the nuki and a kneaded mixture of clays, straws, woods and the like is pasted on opposite surfaces of the komai to provide a bed wall, and after dried, mortars, sands and fiber materials are applied as a finish. Such so-called soil wall contains an innumerable micro pores in its surface and for this reason can serve to automatically control a room temperature and humidity in response to a varying atmospheric condition, and thereby providing a comfortable dwelling state and eliminating the chance of condensation occurring inside the wall and in an advantageous room even at an elevated temperature. Moreover, a heat insulating effect is provided so as to afford people the cool atmosphere in summer and a warm atmosphere in the winter. Furthermore, good soundproof and fireproof effects are provided. Thus, the soil wall was quite ideal meeting the Japanese weather and climate conditions.

However, the above-described wall was labor-intensive for its application and did not permit variations in the design of outer appearance. As a consequence, a number of so-called new building materials have been put on the market and used extensively in recent years.

Such new type wall materials have been adopted at an accelerated tempo in housing applications. These reasons include inter alia that the wall can provide more aesthetic appearance, is simpler to apply and more energy-efficient as a result of its superior heat insulating characteristics.

Despite their popularity, these new wall materials do not share certain benefits of the predecessors, result in problems which relate to lack of gas permeability and poor moisture absorption characteristics and therefore cause condensation to occur in the wall and on the wall surface in a room. The first problem is that moisture passes into the wall from below the floor and is confined in the wall as there is no outlet provided. This moisture evaporates and condenses upon a room temperature increasing or decreasing. Such evaporation or condensation is repeated, whereby significant damage is caused. This damage occurs both to the wall itself and to the major structural members of the building such as columns and sills. This damage may occur in a relatively short period. A lightweight foamed concrete which has attracted concerns in the industry is surely outstanding in its heat insulating effect, but it needs the coating of vinyl-based paints and the like to be applied over its outer surface to prevent the ingress of rain when applied as an outer wall. As a consequence, its inherent gas permeability is lost resulting in the problems described above.

In contrast, homes and other structures built using new building materials have rooms having a substantially improved heat-retaining effect for its improved air-tightness. However, such a room produces a tendency of moisture condensation on wall surfaces once the temperature drops, because its moisture content is not dissipiated easily. Under such a state, molds and fungus will grow easily and impose an adverse effect upon the health of people living in the structure. Over time the living environment of the people living in the structure is impaired and the comfort of the dwelling is lessened.

Furthermore, it is well-known that noise generated from adjacent house units in a collective housing arrangement such as town houses and the like result in social problems.

However, it has been difficult to provide a satisfactory solution to these problems so far.

SUMMARY OF THE INVENTION

It is an object of the present invention to provide a wall material which is devoid of above-mentioned drawbacks by effectively combining several natural materials in such a manner as to make available advantageous properties of individual materials.

It is an another object of the present invention to provide a wall material which can be transported and applied easily by processing the material so that it may have a panel-like configuration.

To accomplish the above-described objects, the wall material in accordance with the present invention is produced by solidifying for integration the mixture of soils and vegetable materials as an unit. Alternatively, hemps and the like may be used in combination with the mixture to reinforce the material so that the material may be integrally solidified in an overlapped and sandwitch-like configuration. In this latter case, the soils should preferably contain clays as much as possible. Straws, palms and hemps are generally used as vegetable materials.

The wall material of the present invention can be prepared in accordance with the procedure to be described hereinbelow.

First, vegetable materials are kneaded and mixed with the soil. Then, the mixture is poured into a form which has been premolded in such a manner it gets generally to an even thickness. The mixture in the form is dried and solidified. After the mixture is dried, the form is removed. Thus, the wall material with the panel-like configuration is obtained.

When hemps and the like are interposed in the mixture, the above-described preparing procedure should be modified as follows. The mixture of soils and the straw is poured into the form, and when the mixture gets to a predetermined thickness, hemps and the like are spreaded over the surface of the mixture. Then, clays, straws, chaffs and the like are poured into the mixture in a similar manner with reinforcing materials placed at corners of the material. Palms and the like are spread over the surface, and additionally the mixture of clays, straws, chaffs and the like are poured. Palms and the like are again spread and then the mixture of clays, straws and chaffs is poured in an even thickness. Hemps are then spread. As a final step, the mixture similar to the above is poured.

The wall material of the present invention is an improvement over the traditional soil wall, while retaining advantageous aspects of heavier wall material. That is, the wall material can function as a heat insulating material, because the soil has the heat insulating effect. Additionally, significant effects may be expected in several aspects as set forth below.

First, since the soil has the water-retaining capability, it can absorb water more with an elevated temperature, and inversely discharge water with a reduced temperature. Thus, humidity in a room is controlled in a suitable state, and thereby eliminating an extraordinary condensation which would otherwise occur over the wall surface. Besides, the wall material of the present invention has a gas permeability, and thus it becomes possible to maintain a temperature in a room at a suitable level in response to an ambient temperature without keeping the room in a completely airtight state as is with the traditional soil wall, if an outer wall and an inner wall surrounding the instant wall material are selected among gas permeable materials.

Taking properties of the raw materials into consideration, soundproofness and fireresisting characteristics are reasonably expected for this wall material. In particular, a lot of straws are used in combination with other vegetable materials, and this permits a significant improvement over the traditional soil wall in the aspect of heat insulation, gas permeability, and soundproofness etc. Moreover, the instant wall material can provide a flexibility which was not available with the traditional soil wall.

Various wall materials of different sizes and configurations can be provided which may match requirements of any wall type of wooden houses and other buildings. In such a case that the wall material is applied into a space between the outer and inner walls, the materials may be applied easily without preparing a preselected void space between the instant materials and the walls, because the materials themselves have an adequate gas permeability.

Moreover, the instant wall material can serve as a reinforcing means of the building itself, and consequently it may improve aseismicity of the building.

BRIEF DESCRIPTION OF THE DRAWINGS

These and other objects of the present invention will become more apparent to those skilled in the art by making reference to the detailed description thereof and several embodiments.

DETAILED DESCRIPTION OF THE INVENTION

Figure 1:
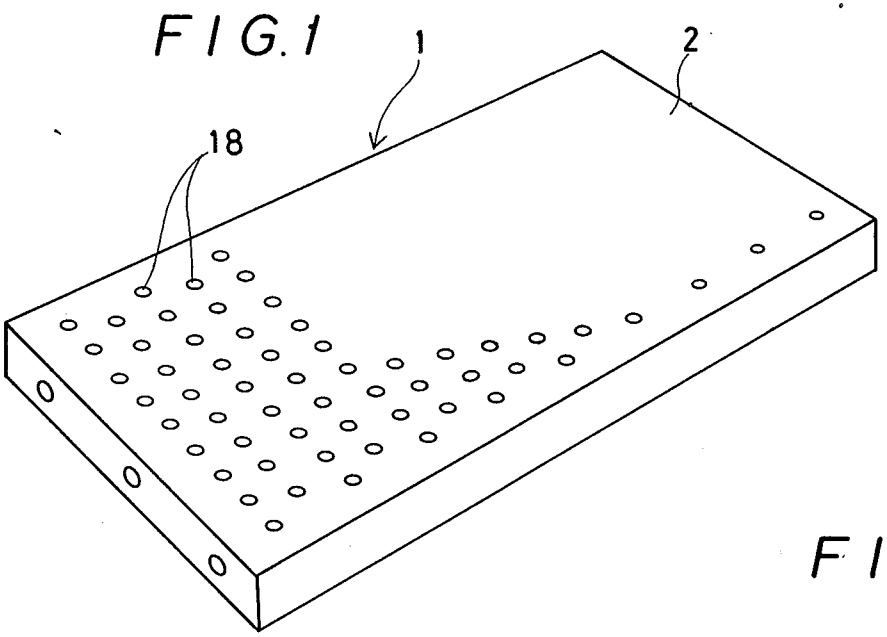
FIG. 1 is a partly cut-out view of the most preferred embodiment of the wall material in accordance with the present invention.
Figure 2:
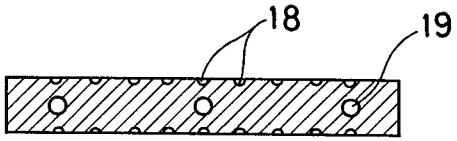
FIG. 2 is a cross-sectional view along the line I—I in FIG. 1.

Illustrated in the drawings is the wall material of the present invention in which the mixture of clays, shreaded straws and chaffs has been dried and solidified in a panel-like configuration. A multiplicity of recesses 18 is defined in the outer surface of the material and three thorough-holes are formed inside the material to extend in a constant direction. The mixing ratio between vegetable materials and the mixture is increased to reduce weight while at the same time maintaining a proper strength.

The wall material above-described is prepared in accordance with the procedure given below.

First, clays, straws, chaffs and palms are kneaded well for mixture. In this case, straws are pulverized to the unit length of approximately 1~3 mm. This operation is conducted for the purpose of getting the straws better fit to the soils, and also increasing the quantity of materials to be mixed up. The use of clays can further increase the mixing ratio of straws and chaffs more than those when the soils containing particles larger than clays are used. That is, the mixing ratio between clays and straws and chaffs can be set as, for example, approximately 1:1. The reason why the mixing ratio of vegetable materials is increased is to reduce the weight of the wall material finished, and at the same time to realize an improvement in the product characteristics such as gas permeability, heat insulation, moisure absorbency, temperature-retenting capability, soundproofness and the like which can be derived from the increase of the surface area due to the expansion of straws and chaffs pulperized at the time of drying.

Further added into the mixture are forming materials which include the fibers of coconut palm tree, i.e., palm materials, fibers of hemps and straws shreaded into the length of approximately 3~5 cm.

Then, the above-described mixture is poured into a form which has been premolded by using the plates etc., in combination in such a manner that a predetermined even thickness is generally realized.

In this case, the form used should be as large as possible to prevent the deflection or the deformation which would otherwise take place during drying, so that a surface area may be made as large as possible at the time of drying. The drying operation should be performed in a room where a temperature is artificially maintained at constant or outdoors where the direct sun may be avoided. A multiplicity of recesses 18 and thorough-holes 19 are defined in the surface of the material.

After the material is dried well, the form is removed and then the materials are cut into a suitable size as desired to make available as a product. The wall material thus obtained is less liable to be cracked, because the above discussed elements are tightly solidified with the progress of the drying operation. The presence of recesses 18 and thorough-holes 18 acts to shorten the time needed to dry the materials. Besides, even as a finished product, such recesses and thorough-holes are advantageous in providing the product with reduced weight, improved gas permeability, a well-controlled room temperature and humidity and improved soundproofness.

Figure 3:
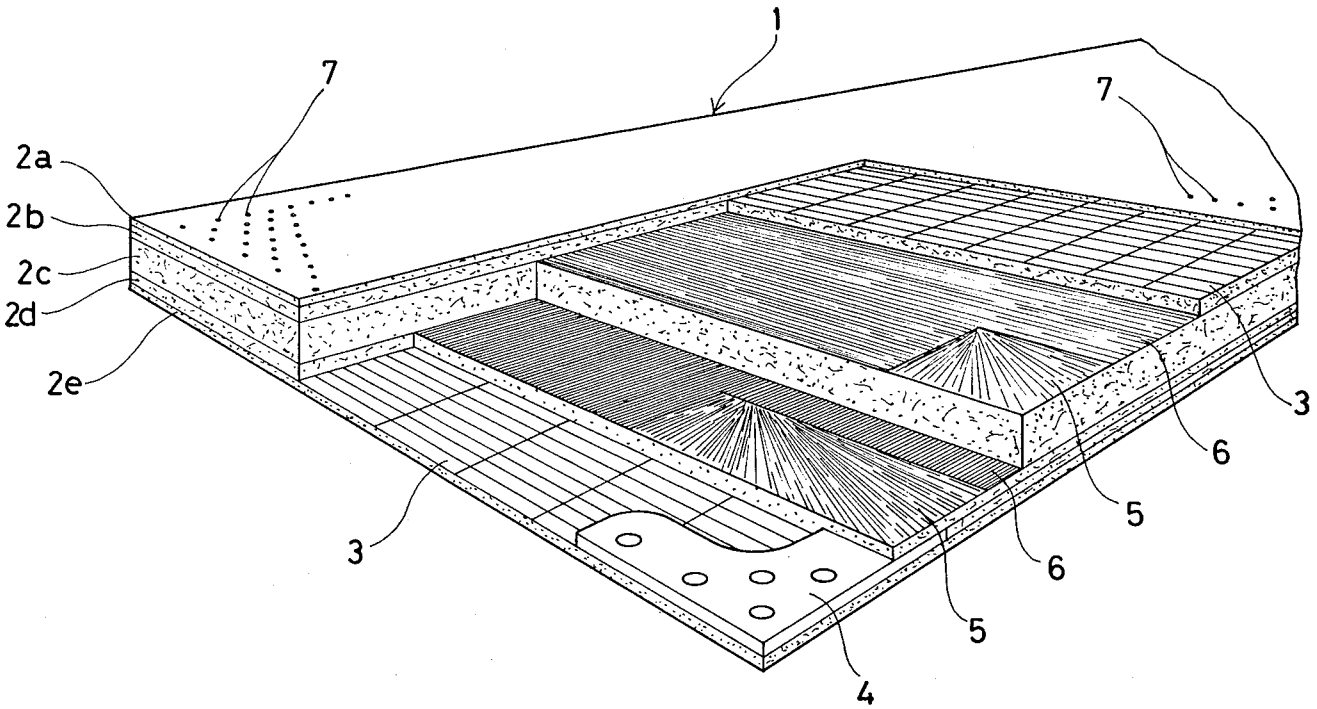
FIG. 3 is a view illustrating an alternative embodiment of the wall material in accordance with the present invention.

As an alternative embodiment, hemps and the like may be interposed in the above-described mixture and overlapped in a sandwich-like configuration to reinforce the wall material as shown in FIG. 3.

The procedure for preparing this alternative embodiment is as follows;

In the step of pouring the mixture of soils and straws etc., into a predetermined form, hemps 3 are spread over the surface of the materials which have been poured into the form with a predetermined thickness. Then, reinforcing materials are placed at the corners of the material, and the mixture 2*d* of clays, straws and chaffs are similarly poured with a predetermined thickness. Palms 5 are spread over the surface of the wall material in an even fashion. Then, straws are spread over the palms at a regular span to orient in a single direction. Moreover, the mixture 2*c* of clays, straws and chaffs is poured, and then the palms 5 is spread evenly over the mixture. Subsequently, the straw is spread at a regular span to orient the straw in a direction different from the direction of increasing the strength of the finished product. Then, the mixture 2*a* of clays, straws and chaffs is poured to a constant thickness, and hemps are spread. Finally, the mixture 2*a* similar to the above-described mixture is poured.

As an example of vegetable materials, hemps, bamboos and woods etc., can be suggested in addition to those above-described.

The wall materials prepared in accordance with the above procedure is formed as shown in FIG. 3 wherein the above mixture and the hemp are overlapped each other in a sandwich like configuration. The straws are spread in a space between the mixtures 2*a*, 2*b* and the mixtures 2*e*, 2*d*. Besides, straws 6 and palms 5 are spread between the mixtures 2*b*, 2*c* and the mixtures 2*c*, 2*d*. Straws 6 of entended length are spread over the palms 5, making their longitudunal directions as neat. These straws 6 are arranged, having their orientations varied between when they are spread between the mixtures 2*b* and 2*c*, and when spread between the mixtures 2*c* and 2*d*. Wooden or bamboo-made reinforcing materials 4 are placed at each corner of the mixture 2*d*. A multiplicity of small holes 7 is defined in the surface of the wall material. Meanwhile, the thickness of the wall material is generally set as approximately 5 cm.

Figure 4:
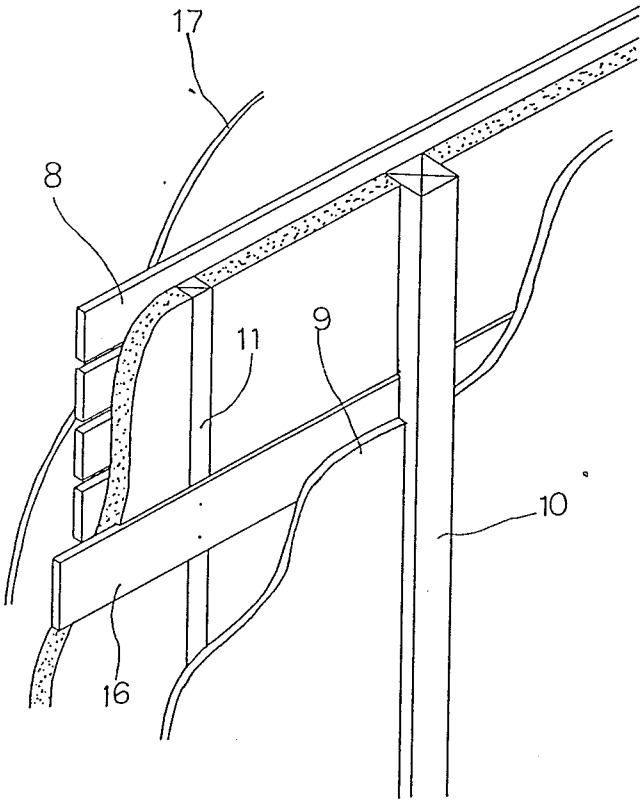
FIG. 4 is a cut-out cross-sectional view illustrating one embodiment of the structure which uses the wall material of the present invention to apply a wall.

FIG. 4 is a cut-out cross-sectional view illustrating one embodiment of a structure wherein the wall material in accordance with the present invention is used to apply a real wall.

The wall material of the present invention is applied as shown in a space between the bed 8 of the outer wall and an interior material 9, and is secured in position by means of a horizontal member 16 (nuki) and partitioned by means of a column 10 and an intermediate column 11.

Figure 5:
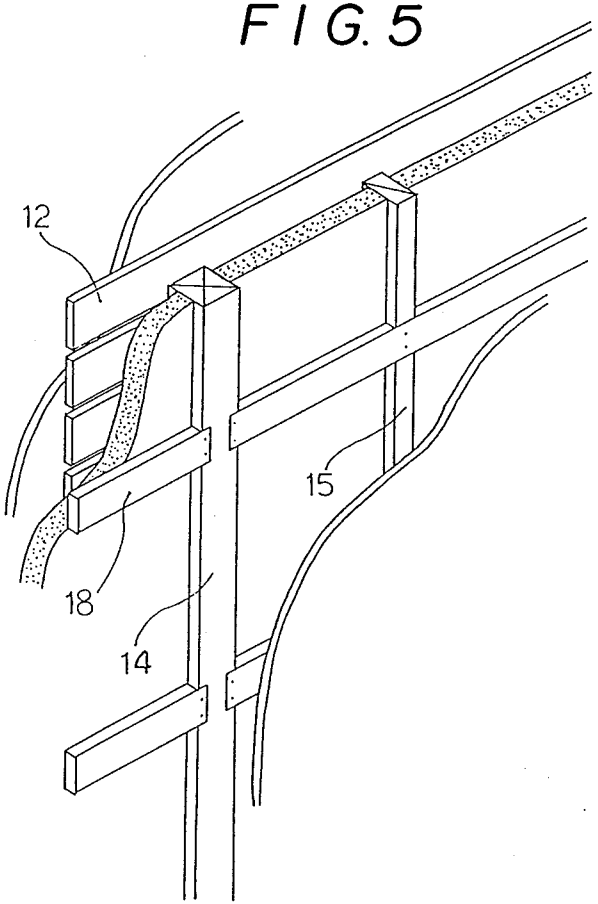
FIG. 5 is a cut-out cross-sectional view illustrating one embodiment of the structure which uses the wall material of the present invention to apply a stud wall framing finished on both sides.

FIG. 5 is a cut-out cross-sectional view illustrating one embodiment of a structure wherein the wall material of the present invention is used to apply a stud wall framing finished on both sides.

The wall material of the present invention is attached to an intermediate space between the bed 12 of the outer wall and an interior material 13. The wall material is secured in position by means of an edge 18 and partitioned by means of an intermediate column 15.

Although a preferred embodiment of the present invention is described as above, and the combination and the arrangement of the materials in this preferred embodiment may be varied variously without deviation from the spirit and the scope of the present invention.

What is claimed is:

1. A wall board structure formed by the steps of:

pulverizing vegetable material including one or more of straw, chaff, bamboo, wood and palm material, such that pulverized the material has a maximum dimension of from 1 to 3 mm;

mixing a substantially equal quantity of clay to the pulverized material;

adding fibrous material to the mixture, the fibrous vegetable material including one or more of palm material fibers, hemp fibers, wood fibers and shredded straw, the fibrous material having a length of from 3 to 5 cm;

pouring the mixture of pulverized material, clay and added fibrous material into a form having mold portions for forming one of recesses and through holes in the poured mixture; and drying the poured material to form a board.

2. A wall board structure according to claim 1, wherein said formed board is overlapped with a similar formed board with vegetable material interposed to form a composite layered structure.

3. A wall board structure, comprising: a mixture of pulverized material including one or more of bamboo, wood, straw, chaff and palm material, the pulverized material having a maximum dimension of from 1 to 3 mm; clay, in amounts substantially equal to said pulverized material; and, fibrous material including one or more of palm fiber materials, hemp fibers and shredded straw, the fibrous material having a length of from 3 to 5 cm, the mixture being dried to form a board structure defining recesses and through holes.

4. A process for preparing a wall material, comprising the steps of:

pulverizing one or more of straw, wood, bamboo chaff and palm material, such that the material has a maximum dimension of from 1 to 3 mm;

mixing a substantially equal quantity of clay to the pulverized material;

adding fibrous material to the mixture, the fibrous material including one or more of palm material fibers, hemp fibers, bamboo fibers, wood fibers, hemp fibers and shredded straw, the fibrous material having a length of from 3 to 5 cm;

pouring the mixture of pulverized material, clay and added fibrous material into a form having mold portions for forming one of recesses and through holes in the poured mixture; and drying the poured material to form a board.

5. A process for preparing a wall material according to claim 4, further comprising the steps of forming a plurality of boards and forming layers utilizing said plurality of board with vegetable material positioned between adjacent boards.

* * * * *